US006971812B1

(12) United States Patent
Chen

(10) Patent No.: US 6,971,812 B1
(45) Date of Patent: Dec. 6, 2005

(54) PEN HAVING A SWINGING DECORATION

(76) Inventor: Chung-Ping Chen, No. 19, Lane 49, Dong Feng Street, Shu-Lin City, Taipei Shien (TW)

( * ) Notice: Subject to any disclaimer, the term of this patent is extended or adjusted under 35 U.S.C. 154(b) by 0 days.

(21) Appl. No.: 11/131,729

(22) Filed: May 18, 2005

(51) Int. Cl.[7] ..... B43K 29/00
(52) U.S. Cl. ..... 401/195
(58) Field of Search ..... 401/195, 52; 446/330, 446/333

(56) References Cited

U.S. PATENT DOCUMENTS 5,927,881 A * 7/1999 Yang ..... 401/29
6,254,298 B1 * 7/2001 Hsu ..... 401/195
6,332,727 B1 * 12/2001 Hsu ..... 401/195
6,688,794 B1 * 2/2004 Hsu ..... 401/195

* cited by examiner

*Primary Examiner*—David J. Walczak
(74) *Attorney, Agent, or Firm*—Pro-Techor Int'l Services

(57) ABSTRACT

A pen with a swinging decoration includes a decoration in a shape with two hands and two legs at a top end of a penholder of an ordinary pen. A refill is pushed against a top shaft to move upward and pressed against a swing, whereas teeth rows at two edges of the top shaft drive conjugate gears to rotate at the same time, so as to swing the two hands and two legs having gears upward and downward at the same time, upon writing with the pen.

1 Claim, 4 Drawing Sheets

PEN HAVING A SWINGING DECORATION

BACKGROUND OF THE INVENTION a) Field of the Invention

The present invention relates to a pen having a swinging decoration, and more particularly to a pen whose top is provided with a decoration in a shape of a clown whose hands and legs will swing upward at the same time of pressing a pen-point upon writing, and will restore to their original positions by a restoring force of a spring when the force exerted to the pen-point is relaxed.

b) Description of the Prior Art

A conventional pen is only capable of writing without other additive functions. To increase the fin of pen, some vendors have installed a decoration of a puppet, a cartoon character, or a feather-like object at a top of the pen. However, all these decorations belong to a design of standstill without swinging, thereby being unable to provide a fun of swinging achieved during writing with the pen.

SUMMARY OF THE INVENTION

The primary object of the present invention is to provide a vivid and funny writing tool which is constituted by a decoration in a shape of a clown at a top of a pen with the hands and legs of the decoration swinging upward at the same time of pressing a refill upon writing, and swinging downward upon stopping writing.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
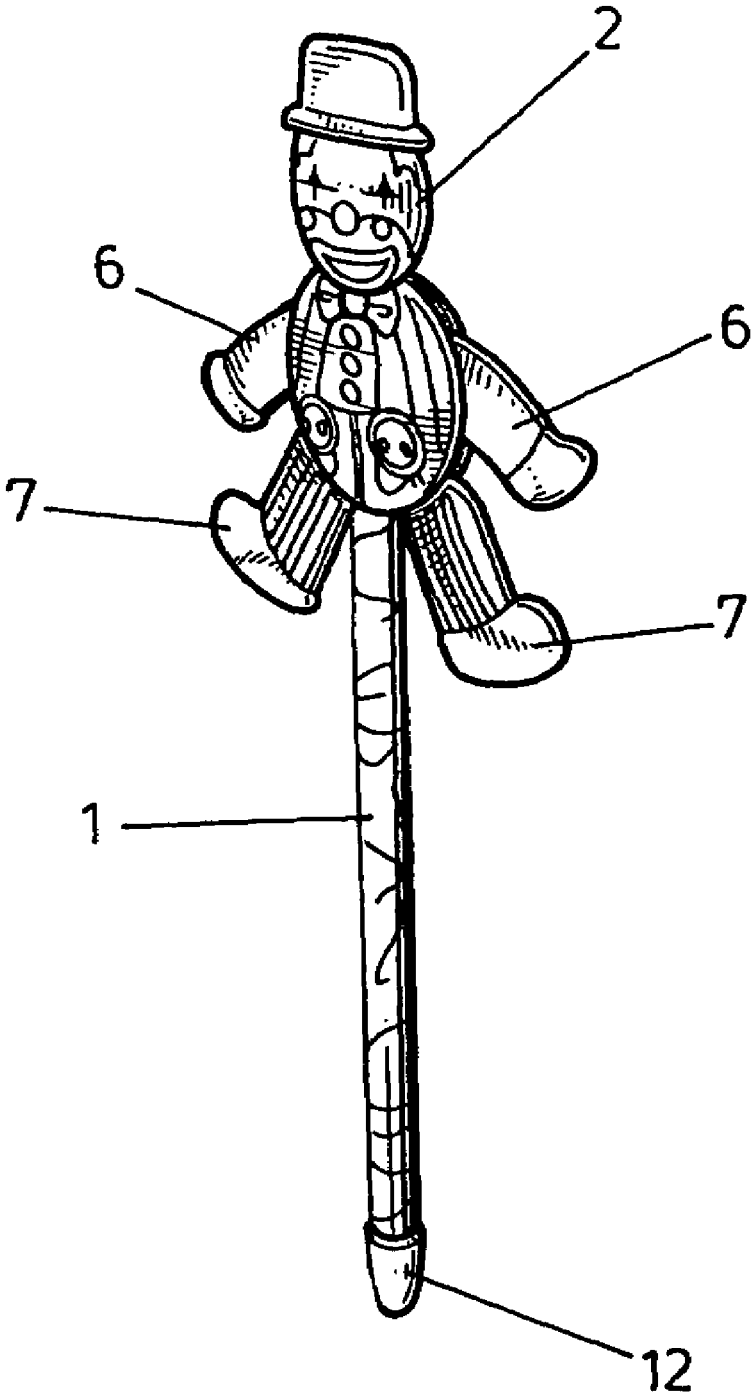
FIG. 1 shows a perspective view of the present invention.
Figure 2:
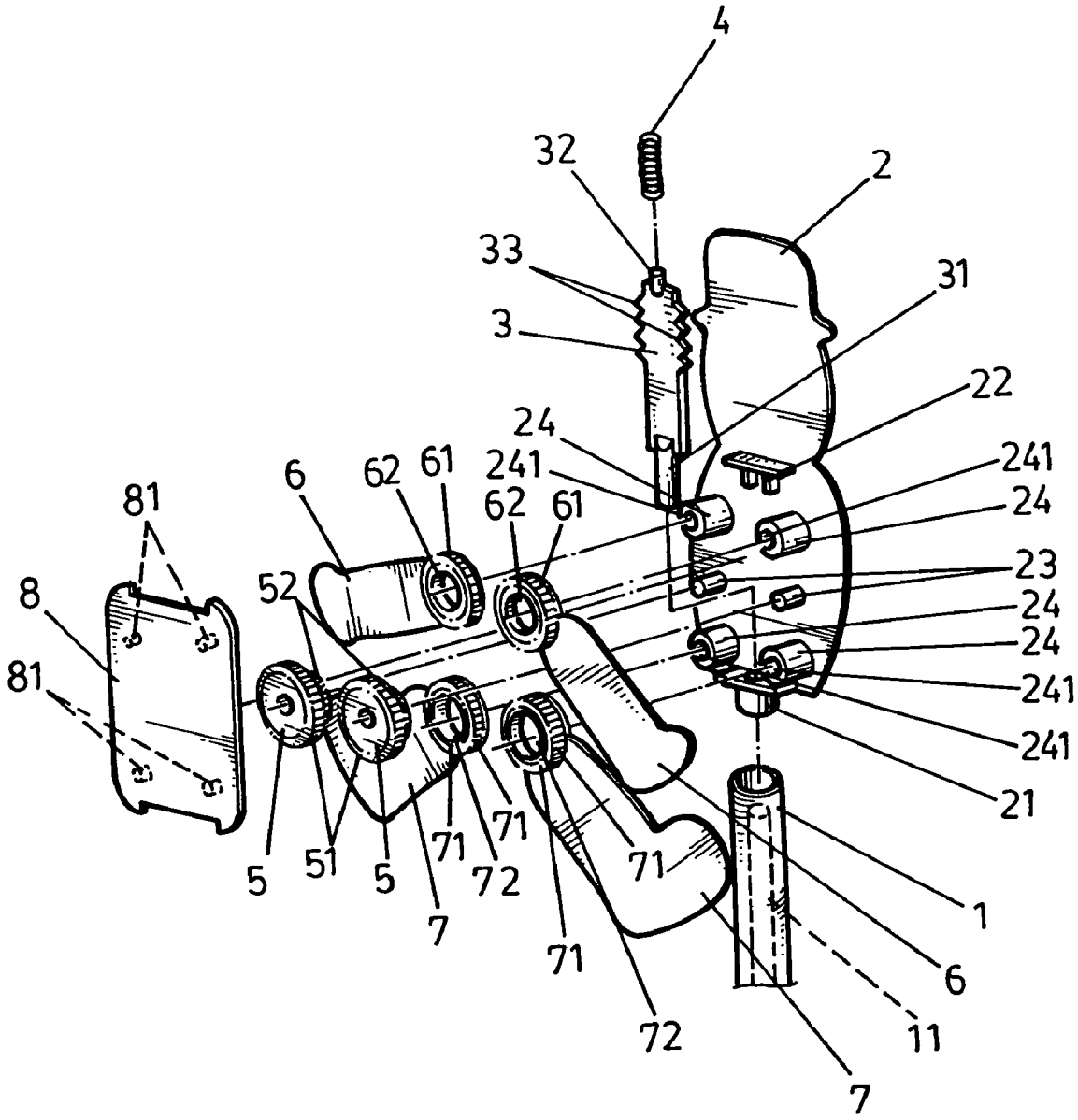
FIG. 2 shows a perspective view of compartments of the present invention.
Figure 3:
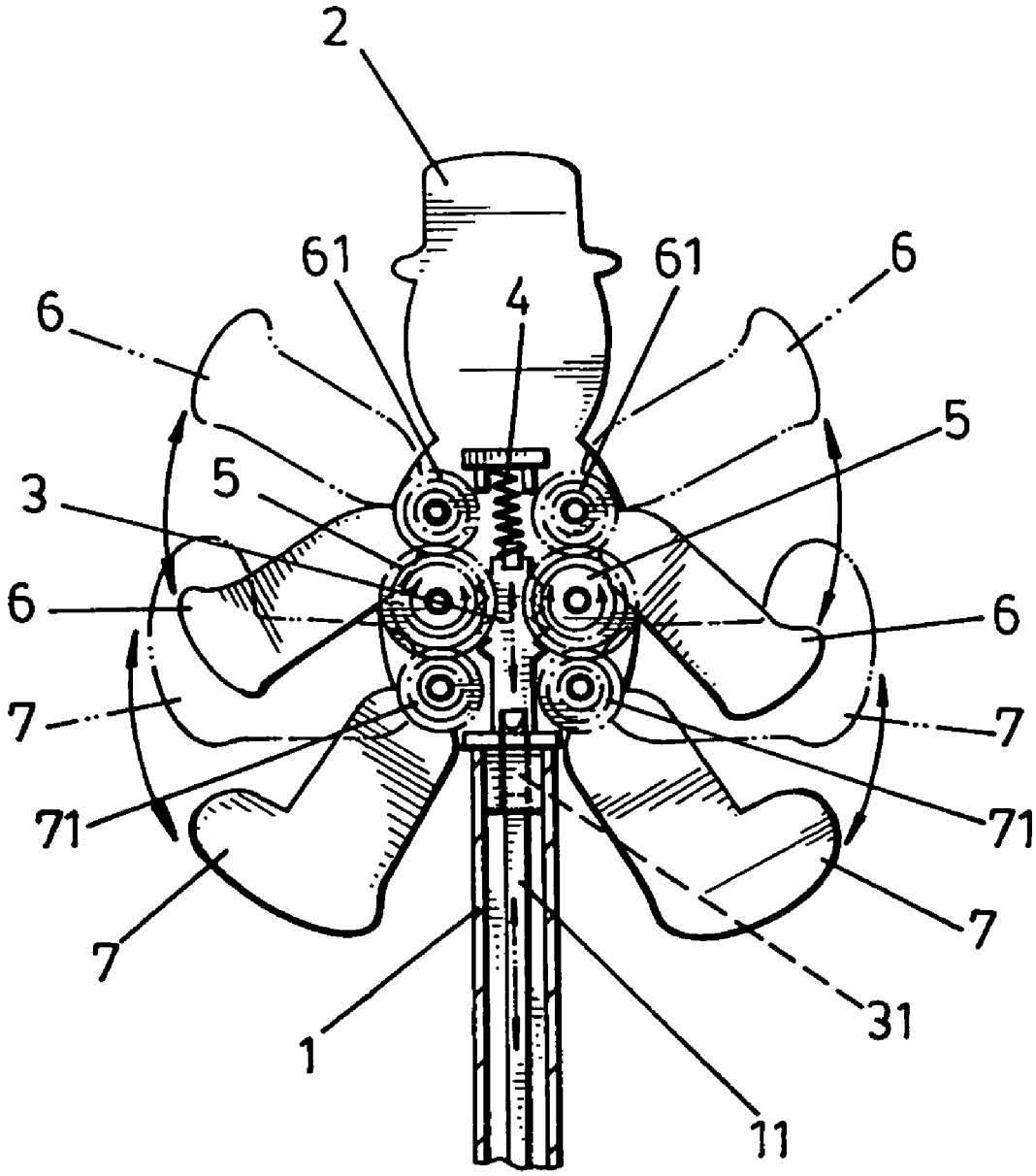
FIG. 3 shows a schematic view of motion of a cross section of the present invention.

Referring to FIG. 1 to FIG. 3, the present invention comprises a penholder 1, a decoration 2, a top shaft 3, a spring 4, two conjugate gears 5, two hand parts 6, two leg parts 7, and a cover plate 8, wherein a refill 11 is located inside the penholder 1, a cap 12 is covered at a bottom of the penholder 1, and the decoration 2 is in a shape of clown.

A hollow tube 21 is located at a bottom end at a back side of the decoration 2, a spring seat 22 in a U-shape is located at a top end at the back side of the decoration 2, a straight rod 31 at a bottom end of the top shaft 3 can be extended into the hollow tube 21, and the spring 4 can be emplaced on a protruded pin 32 at a top end of the top shaft 3. Two rows of teeth 33 in a shape of saw-tooth are located at two edges above the straight rod 31, and a top end of the spring 4 can be emplaced in the spring seat 22. Two conjugate gears 5 are installed on two protruded columns 23 at a center of the decoration 2, respectively. Each conjugate gear 5 is composed by a large and a small gear 51, 52 in parallel, wherein the small gears 52 are engaged with the teeth rows 33 of the top shaft 3, and the large gears 51 are engaged with gears 61, 71 at one end of the hand parts 6 and leg parts, which are located at a top and a bottom end, respectively. Circular holes 62, 72 of the hand parts 6 and the leg parts 7 are installed on cylinders 24 of the decoration 2, respectively. Four latch pins 81 in an interior of the cover plate 8 are latched into holes 241 of the cylinders 24 of the decoration 2 for positioning.

Figure 4:
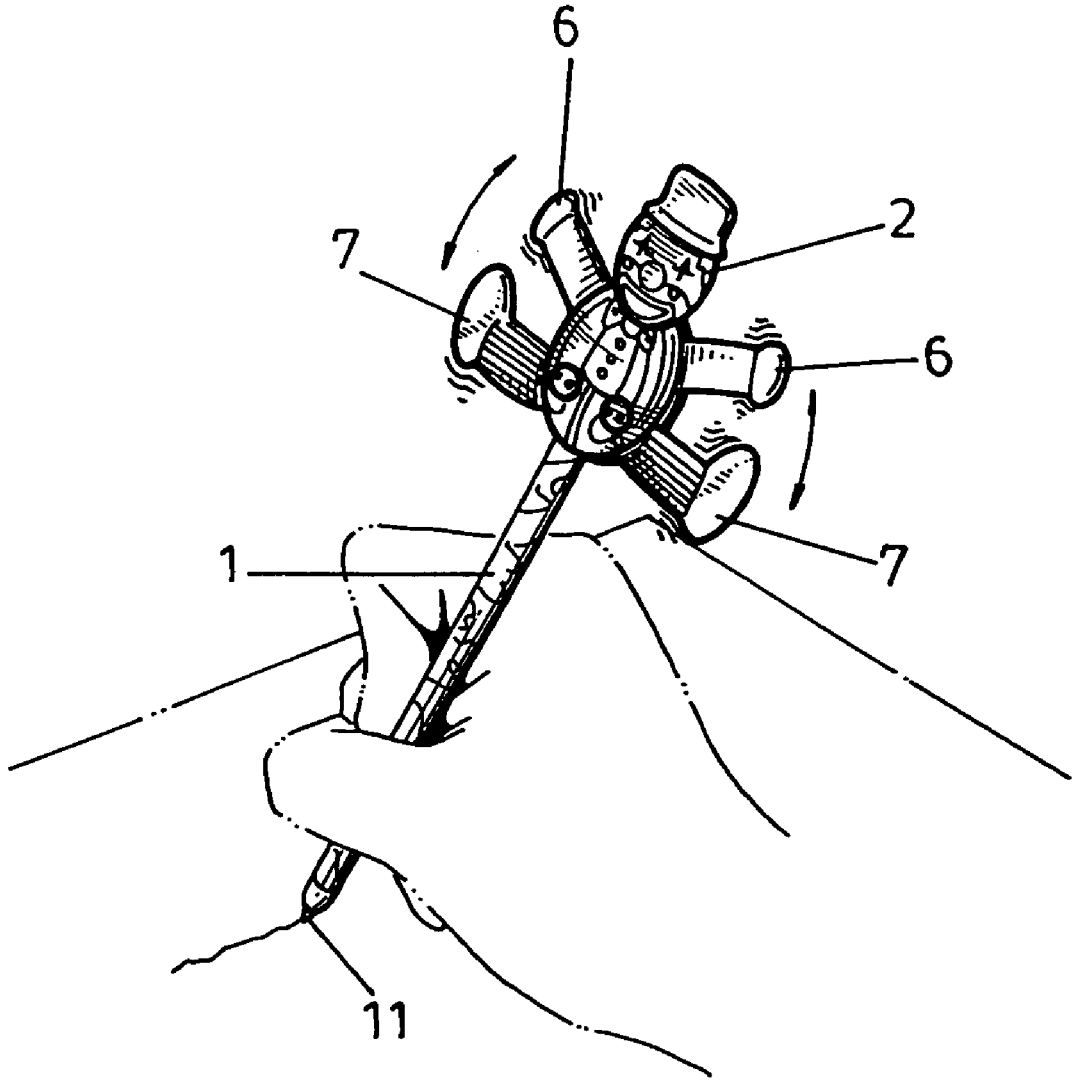
FIG. 4 shows a schematic view of an implementation upon writing with the present invention.

As shown in FIG. 4, when a user writes on a paper with the pen, the refill 11 inside the penholder 1 is pushed upward against the top shaft 3 via the hollow tube 21 of the decoration 2, the top shaft 3 is in turn pushed upward against the spring 4, and the teeth rows 33 at two edges of the top shaft 3 drive the conjugate gears 5 to rotate, respectively. The conjugate gears 5 drive the gears 61, 71 of the two hand parts 6 and the two leg parts 7 to rotate at the same time, thereby swinging the hands and legs upward. When the force exerted to the refill 11 is relaxed (not writing), a restoring force of the spring 4 can push the top shaft 3 downward, and the teeth rows 33 in turn drive the conjugate gears 5 to rotate. The conjugate gears drive the gears 61, 71 of the two hand parts 6 and the two leg parts 7 to rotate at the same time, thereby swinging the hands and legs downward.

Accordingly, the present invention can drive the decoration at the top end of the pen to swing upward and downward upon writing with the pen.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A pen having a swinging decoration comprising a penholder wherein, an interior of the penholder is provided with a refill, and a bottom of the penholder is covered with a cap; a decoration having a bottom end thereof provided with a hollow tube, and having a back side which is provided with protruded columns with cylinders having holes located at an upper and lower end of the protruded columns; a top shaft having a bottom end is provided with a straight rod which is extended into the hollow tube of the decoration; the top shaft having a protruded pin, and rows of teeth at two edges thereof; a spring having one end is emplaced on the protruded pin of the top shaft, and the other end thereof is against a spring seat of the decoration; two conjugate gears, composed of large and small gears, installed on the protruded columns of the decoration, respectively; two hand parts having circular holes at one end are installed on the cylinders of the decoration, respectively, with gears at outer edges of the circular holes engaged with the conjugate gears, respectively; two leg parts having circular holes at one end are installed on other cylinders of the decoration, respectively, with gears at outer edges of the circular holes engaged with the conjugate gears, respectively; a cover plate having latching pins at one end can be latched into the holes of cylinders of the decoration; the two hand parts and two leg parts swinging upward and downward upon writing with the pen constituted by the aforementioned compartments.

* * * * *